US005226349A

United States Patent [19]

Alme et al.

[11] Patent Number: 5,226,349

[45] Date of Patent: Jul. 13, 1993

[54] VARIABLE DISPLACEMENT HYDROSTATIC PUMP AND IMPROVED GAIN CONTROL THEREOF

[75] Inventors: Nathan J. Alme, Eden Prairie; Robert C. Horst, Coon Rapids, both of Minn.

[73] Assignee: Eaton Corporation, Cleveland, Ohio

[21] Appl. No.: 914,824

[22] Filed: Jul. 15, 1992

[51] Int. Cl.[5] ..... F01B 3/04

[52] U.S. Cl. ..... 91/506; 92/12.2

[58] Field of Search ..... 91/506, 505; 92/12.2; 417/222.1

[56] References Cited

U.S. PATENT DOCUMENTS 2,896,546 7/1959 Lundgren et al. ..... 91/506

3,945,764 3/1976 Marietta ..... 91/506 X

FOREIGN PATENT DOCUMENTS 1297993 6/1969 Fed. Rep. of Germany ..... 91/505

*Primary Examiner*—Richard A. Bertsch

*Assistant Examiner*—Roland McAndrews

*Attorney, Agent, or Firm*—L. J. Kasper

[57] ABSTRACT

A variable displacement axial piston pump (11) is disclosed of the type including a displaceable cam member (39) to vary the pump displacement in response to operation of a fluid pressure actuated servo assembly (15). The servo assembly includes a servo piston (47), the position of which is controlled in response to control fluid in a pair of servo chambers (53,55). The flow of control fluid pressure from a charge pump (27) to the servo chambers is controlled by a manual controller (17), which includes a main control orifice (105). The nominal gain rate of the pump and servo assembly is determined largely by the main control orifice (105). The servo piston (47) defines a servo orifice (113) communicating between the servo chambers. The servo orifice is sized, relative to the main control orifice whereby, for relatively large control inputs, the gain rate is substantially equal to the nominal gain rate, but for relatively small inputs, the gain rate is substantially less than the nominal gain rate, to provide smoother, more controllable operation of the vehicle.

13 Claims, 2 Drawing Sheets

VARIABLE DISPLACEMENT HYDROSTATIC PUMP AND IMPROVED GAIN CONTROL THEREOF

BACKGROUND OF THE DISCLOSURE

The present invention relates to variable displacement hydrostatic pumps of the axial piston type, and more particularly, to such pumps of the type wherein the pump displacement is controlled by a fluid pressure actuated servo assembly.

Many variable displacement hydrostatic pumps of the type to which the present invention relates are utilized in the field of mobile hydraulics, i.e., as part of the hydraulic system of various types of vehicles. Furthermore, many such pumps are utilized in the "propel circuit", i.e., to supply fluid under pressure to a fluid motor which transmits torque to the drivewheels of the vehicle.

An example of a vehicle which would typically utilize a hydrostatic propel circuit would be a skid-steer loader. It is desirable to provide the axial piston pump with a fluid pressure-actuated servo assembly to control the pump displacement, rather than requiring the vehicle operator to control pump displacement manually, in order to minimize operator fatigue. One of the key performance criteria for a servo assembly of the type used to vary the displacement o an axial piston pump is the responsiveness of the servo. In other words, as the pump is displaced from its neutral position (zero output flow) to a particular displaced position (either forward or reverse) it is not acceptable to have excessive time delay between movement o the manual control by the operator and changes in the pump displacement. The rate of change of pump displacement, for a given movement of the manual input, is referred to as the "gain rate".

It has generally been considered desirable by the operators of such vehicles to have a relatively high gain rate when selecting relatively large pump displacements. However, it has been found that on vehicles having a high-gain rate pump and servo assembly, the attempt by the operator to make small corrections in the pump displacement typically results in excessive displacement changes, making it difficult to control the vehicle, especially when maneuvering the vehicle in tight quarters.

SUMMARY OF THE INVENTION

Accordingly, it is an object of the present invention to provide an improved variable displacement hydrostatic pump which is capable of operating at a relatively high gain rate, in response to relatively large control inputs, and operating at a substantially lower gain rate, for relatively lower control inputs.

The above and other objects of the present invention are accomplished by the provision of a variable displacement hydrostatic pump of the type comprising housing means, a cylinder barrel rotatably mounted within the housing means, and defining a plurality of cylinders, and a piston disposed within each cylinder. A cam support is disposed within the housing means and cam means are mounted on the cam support and are pivotable relative thereto, the cam means including a swash plate operably associated with each of the pistons to cause reciprocal movement thereof in response to rotation o the cylinder barrel, when the cam means is displaced from the neutral position in either the first or second opposite direction. A fluid pressure actuated servo assembly comprises the housing means defining a servo cylinder, and a servo piston disposed within the servo cylinder and cooperating therewith to define first and second servo chambers adapted for connection to a source of control fluid pressure. Linkage means is operably associated with the cam means and the servo piston whereby the cam means is displaced, from the neutral position, in the first direction, in response to control fluid pressure in the first servo chamber, and the cam means is displaced from the neutral position in the second direction, in response to control fluid pressure in the second servo chamber.

The improved hydrostatic pump is characterized by the servo piston defining orifice means providing restricted fluid communication between the first and second servo chambers. The orifice means is sized whereby, for a relatively large input of control fluid pressure, the gain rate of the pump and servo assembly is substantially equal to a nominal gain rate, and for a relatively small input of control fluid pressure, the gain rate of the pump and servo assembly is substantially less than the nominal gain rate.

DESCRIPTION OF THE PREFERRED EMBODIMENT

Figure 1:
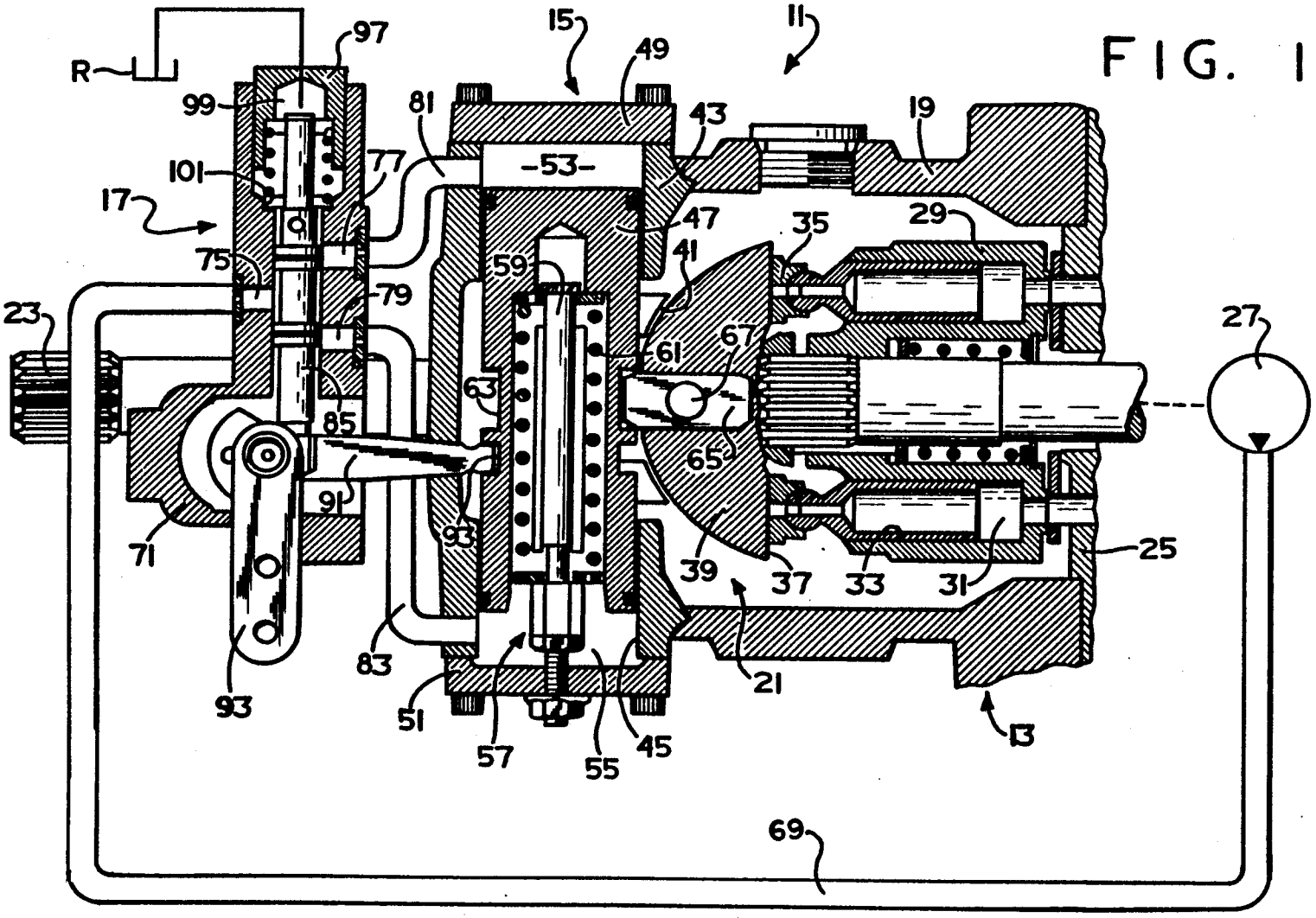
FIG. 1 is a somewhat schematic, axial cross-section of a variable displacement hydrostatic pump of the type to which the present invention may be utilized.

Referring now to the drawings, which are not intended to limit the invention, FIG. 1 illustrates, somewhat schematically, a variable displacement axial piston pump, generally designated 11, of the type with which the present invention may be utilized. The pump 11 comprises three main portions: a pumping element 13; a fluid pressure actuated servo assembly 15; and a manual controller 17.

The pumping element 13 includes a pump housing 19 which defines an internal cavity 21. An input shaft 23 extends from the left in FIG. 1 into the internal cavity 21, and then extends to the right in FIG. 1 through an opening in a port housing 25 to drive a charge pump 27 (shown only schematically in FIG. 1).

Disposed about the input shaft 23, within the internal cavity 21, is a cylinder barrel 29, which is splined to the input shaft 23 to rotate therewith. The barrel 29 defines a plurality of cylinder bores 31, and disposed for reciprocating motion within each bore 31 is a piston 33. Each piston 33 includes a generally spherical head which is received within a piston shoe 35. The piston shoes 35 are retained in contact with a swash plate 37 in a manner generally well known to those skilled in the art, and which forms no part of the present invention. The swash plate 37 is carried by a cam member 39, which is typically mounted in a cam support 41, and may merely comprise the surface of the cam member 39. In FIG. 1, the cam member 39 is in its neutral position, and movement of the cam member 39 form the neutral position, in either direction, will result in the stroke of the pistons 33 being changed in such a way that rotation o the barrel 29 will result in an output flow of pressurized fluid from the pumping element 13.

The fluid pressure actuated servo assembly 15 comprises, in the subject embodiment, a separate servo housing 43 suitably attached to the pump housing 19, but in a way which leaves the interior of the housing 43 at least partially open to the internal cavity 21, for reasons which will become apparent subsequently. The servo housing 43 defines a servo cylinder 45, and axially displaceable therein is a servo piston 47, which is shown in its neutral position in FIG. 1, corresponding to the neutral position of the cam member 39.

Bolted to the servo housing 43 is an upper end cap 49, and a lower end cap 51, the end caps 49 and 51 cooperating with the housing 43 and the piston 47 to define upper and lower servo chambers 53 and 55, respectively. The servo piston 47 is provided with a neutral centering spring assembly 57, the function of which is to return the servo piston 47 to its neutral position shown in FIG. 1, in the absence of control fluid pressure in either of the chambers 53 or 55. The neutral centering spring assembly 57 primarily comprises a spring support member 59, which is in threaded engagement with an opening in the lower end cap 51, and further comprises a coil compression spring 61 which is seated within the servo piston 47 and the centering assembly 57 in such a way that the spring 61 is compressed if the servo piston 47 moves in a first direction (downward in FIG. 1) or in a second direction (upward in FIG. 1).

The servo piston 47 defines an annular groove 63 which receives the forward end of a servo piston follower 65. The follower 65 is attached to the cam member 39 by means of a follower pin 67, which is offset from the axis of pivotal movement of the cam member 39. As a result, movement of the servo piston in the first direction will move the servo piston follower 65 downward, causing the cam member 39 to pivot in a first direction (counter-clockwise in FIG. 1) from its neutral position. Conversely, movement of the servo piston 47 in the second direction will cause the follower 65 to move upward, causing the cam member 39 to pivot in a second direction (clockwise in FIG. 1) from the neutral position.

In the operation of the axial piston pump 11, the vehicle operator is able to vary the pump displacement (e.g., to vary the speed of the vehicle) by controlling the flow of control fluid pressure from the charge pump 27 through a conduit 69, to the manual controller 17 which, in turn, controls the control fluid pressure in the servo chambers 53 and 55, and thus, the displacement of the cam member 39.

The manual controller 17 is generally well known to those skilled in the art, and may be better understood by reference to U.S. Pat. No. 4,050,247, assigned to the assignee of the present invention and incorporated herein by reference. The controller 17 includes a controller housing 71 which defines a spool bore 73, a control port 75, which is in communication with the conduit 69, and a pair of servo ports 77 and 79, which are in fluid communication with the servo chambers 53 and 55, respectively, by means of a pair of conduits 81 and 83, respectively.

Disposed within the spool bore 73 is a control spool 85, including upper and lower spool lands 87 and 89, which block fluid communication from the control port 75 to the servo ports 77 and 79, respectively, when the control spool 85 is in the centered, neutral position shown in FIG. 1.

Attached to the lower end o the control spool 85 is a feedback link 91, which has its other end (right end in FIG. 1) received in an annular groove 93 defined by the servo piston 47. Also connected to the lower end of the control spool 85 is a control lever 95 by means of which the vehicle operator is able to shift the control spool 85 from its neutral position shown in FIG. 1 in either a first direction (upward in FIG. 1) or a second direction (downward in FIG. 1), to port control fluid pressure from the conduit 69 in the manner described previously. The upper end of the controller housing 71 receives a generally hollow plug 97 to define a cavity 99 which is in fluid communication with the system reservoir R, and therefore, is at substantially zero fluid pressure. Disposed within the cavity 99 is a centering spring assembly 101, the function of which is to bias the control spool 85 toward the neutral position shown in FIG. 1, in the absence of a control input, by means of a control lever 95.

As is well known to those skilled in the art, if the control lever 95 is rotated clockwise in FIG. 1 (i.e., the lower end thereof is moved to the left), the control spool 85 moves in the first direction (upward in FIG. 1), such that the upper spool land 87 moves upward, permitting communication of control fluid pressure from the control port 75 to the servo port 77, and from there to the upper servo chamber 53. In turn, the servo piston 47 will move in its first direction (downward in FIG. 1), displacing the cam member 39 in its first position, as was described previously. After the appropriate amount of control fluid pressure has flowed into the upper servo chamber 53, the downward movement of the servo piston 47 moves the feedback link 91 downward, returning the control spool 85 to the neutral position. The control lever 95 will remain in its displaced position (clockwise from the position show in FIG. 1), the displaced position corresponding approximately to the commanded swash angle of the cam member 39.

Figure 3:
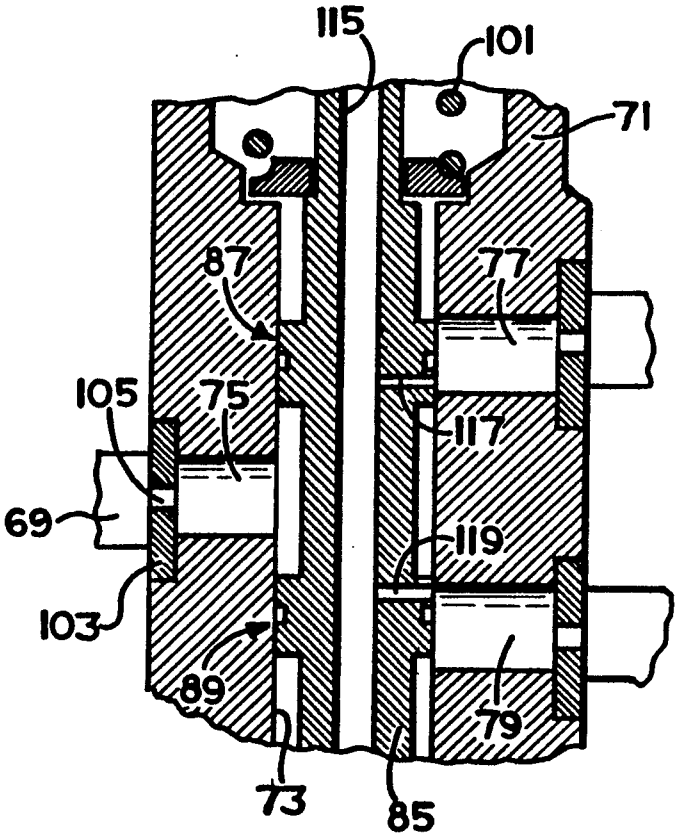
FIG. 3 is an enlarged, fragmentary, axial cross-section of part of the manual controller shown in FIG. 1, illustrating an alternative embodiment of the present invention.

Referring now to FIG. 3, in conjunction with FIG. 1, it should be noted that FIG. 3 is included to illustrate an alternative embodiment of the invention, which will be described subsequently, but will also be referred to in connection with another feature of the manual controller 17. At the entrance of the control port 75, the controller housing 71 defines a counterbore, and seated therein is a control orifice member 103. The member 103 defines a control orifice 105, of the type which is well known to those skilled in the art, and in widespread commercial use in controllers of the type shown in FIG. 1. One of the functions of the control orifice 105 is to limit the "gain rate" of the axial piston pump 11, i.e., the speed at which the cam member 39 moves to the commanded swash angle, in response to input movement of the control lever 95. It should be apparent in viewing FIGS. 1 and 3 that, without the control orifice 105, very slight movements of the control lever 95 would result in a substantial flow of control fluid to whichever of the servo chambers 53 or 55 was being pressurized.

The control orifice 105 is typically selected so that relatively large movements of the control lever 95 will result in movement of the cam member 39 to its commanded position at a gain rate which provides satisfactory response time, for the particular vehicle application. By way of example only, in the subject embodiment, the cam member 39 can pivot from the neutral position shown in FIG. 1 about 17 degrees in the first direction (for forward propel) or in the second direction (for reverse propel). For relatively large displacements (for example, any displacement in excess of about 7 or 8 degrees), it is normally considered desirable for the pump to respond at the nominal gain rate as established, or limited, by the control orifice 105. However, as was discussed in the Background of the specification, for relatively small displacements (for example, cam displacements of less than about 4 degrees), it is desirable to operate at a lower gain rate.

Figure 2:
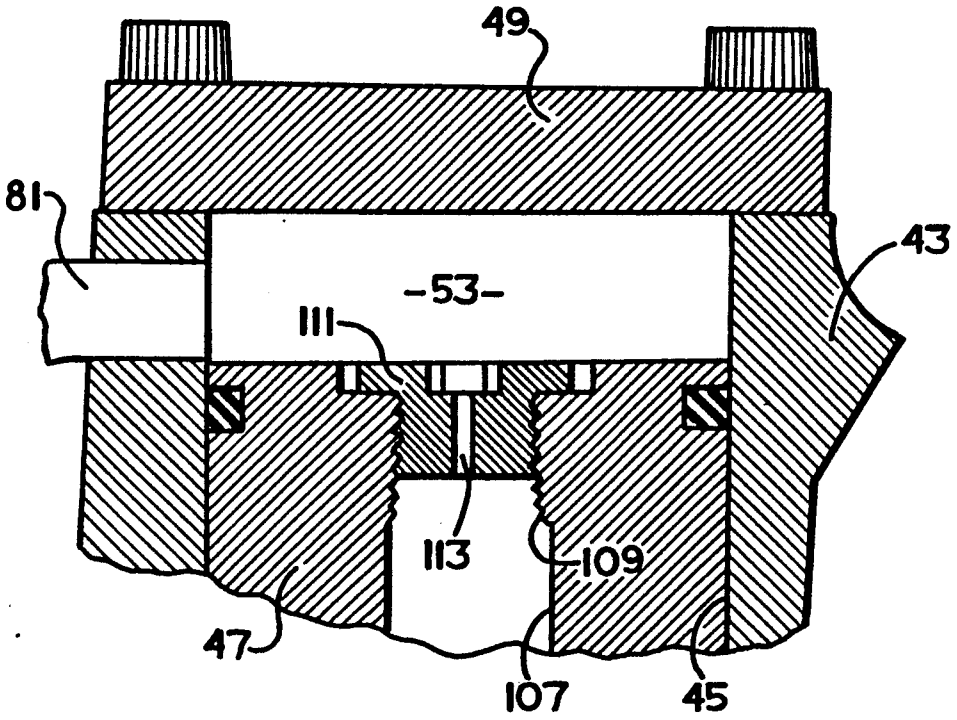
FIG. 2 is a fragmentary, axial cross-section, similar to FIG. 1, but on a larger scale, illustrating one aspect of the present invention.

Referring now to FIG. 2, in conjunction with FIG. 1, it is one important aspect of the present invention to provide a relatively simple, inexpensive means by which the servo and pump assembly can have a gain rate substantially equal to the nominal gain rate for relatively large control inputs, while having a gain rate substantially less than the nominal gain rate for relatively small control inputs. The servo piston 47 defines a blind bore 107 into which the spring support member 59 can extend, when the servo piston moves downward in FIG. 1. At the upper end o the bore 107 (shown only in FIG. 2), a hole 109 has been drilled and tapped, and counterbored, the hole 109 extending completely through as shown in FIG. 2. A threaded orifice member 111 is threaded into the hole 109, preferably to a position in which the member 111 is flush with the upper surface of the servo piston 47. The orifice member 111 defines a servo orifice 113 which provides restricted fluid communication between the upper servo chamber 53 and the lower servo chamber 55, i.e., through the bore 107 and downward through the interior of the servo piston 47.

In accordance with another aspect of the present invention, the servo orifice 113 is selected, in terms of its orifice diameter and flow area, such that it has no substantial effect on the gain rate of the servo and pump assembly when relatively large pump displacements are commanded. In other words, the gain rate is substantially equal to the nominal gain rate of the system, as determined by the control orifice 105. On the pump on which the present invention was developed, and by way of example only, the diameter of the control orifice 105 is typically in the range of about 0.040 inches to about 0.060 inches. As used herein, by "substantially equal", it is meant that there should be no noticeable degradation in the responsiveness of the entire system, so as to be noticeable to the vehicle operator. However, when relatively small displacements are commanded, the presence of the servo orifice 113, communicating between the servo chambers 53 and 55, reduces the rate at which the control fluid pressure builds in the upper servo chamber 53, thus reducing the overall gain rate of the servo and pump assembly. By way of example only, in the course of developing the subject embodiment of the invention, several different orifice members 111 were utilized, with the servo orifice 113 having diameters in the range of about 0.025 inches to bout 0.030 inches. It is believed to be within the ability of those skilled in the art, for any given combination of pumping element 13, servo assembly 15, and manual controller 17, to select an appropriate combination of control orifice 105 and servo orifice 113, which will provide the desired overall gain rate of the servo and pump assembly, while at the same time, providing a sufficiently reduced gain rate for smaller group displacements.

Those skilled in the art will understand that, in order to provide the desired, reduced gain rate for small pump displacements, it is not acceptable merely to provide increased clearances somewhere in the control system, to promote cross-servo leakage, such as by increasing the clearance between the servo cylinder 45 and the servo piston 47. Such a clearance would not provide a consistent, repeatable gain rate and overall performance by the pump 11. Instead, it is important to select and carefully coordinate the control orifice 105 and the servo orifice 113, in order to have a consistent, repeatable gain rate at the smaller group displacement.

Referring now primarily to FIG. 3, there is illustrated, in addition to the structure described thus far in connection with FIG. 3, an alternative embodiment of the invention. In the embodiment of FIG. 3, the control spool 85 includes an axially-extending bore 115, which preferably extends all the way to the upper end of the spool 85 in FIG. 1, such that the bore 115 is in open, unrestricted communication with the system reservoir. In referring to FIG. 1, it should be noted that the control spool 85 is fixed non-rotatably within the spool bore 73, by virtue of its connection to the feedback link 91 and the control lever 95. The significance of the this factor will now become apparent. Referring again to FIG. 3, it may be seen that a very small radial orifice 117 is drilled through the upper spool land 87, into communication with the bore 115. Similarly, a very small radial orifice 119 is drilled in the lower spool land 89, also into communication with the bore 115. The orifices 117 and 119 are in open communication with the servo ports 77 and 79, respectively, when the control spool 85 is in its neutral position shown in FIG. 3.

In operation, when the control lever 95 is rotated, as described previously, to move the control spool 85 in its first direction (upward in FIGS. 1 and 3), the upper spool land 87 moves to uncover the servo ports 77, and control fluid pressure is communicated from the control port 75 through to the servo port 77, in the same manner as was described previously.

The alternative embodiment of FIG. 3 differs from the primary embodiment described previously in that the servo chambers 53 and 55 are not effectively cross-ported by an orifice. Instead, the inclusion of the radial orifice 117 in the embodiment of FIG. 3 communicates a small amount of control fluid pressure from the servo port 77 (which is effectively the same as communicating from the upper servo chamber 53) into the bore 115 and to the system reservoir. Preferably, each of the radial orifices 117 and 119, in the alternative embodiment, would be sized approximately the same as the servo orifice 113 in the primary embodiment. Those skilled in the art will appreciate that having the orifice 117 communicate control fluid pressure to the system reservoir R is generally the functional equivalent of having the servo orifice 113 communicate the upper servo chamber 53 to the lower servo chamber 55, because, when the control spool is in its first position (upward in FIGS. 1 and 3), the lower servo chamber 55 is in relatively unrestricted fluid communication with the system reservoir through the conduit 83 and the servo port 79 in a manner well known to those skilled in the art.

Although the invention has been described in connection with an axial piston pump of the "cradle" type, having a single servo piston, it should be apparent to those skilled in the art that the invention is equally adapted for use with an axial piston device of the swash plate and trunnion type in which there are two separate stroking cylinders, each of which biases the swash plate in a different direction. In a device of the trunnion type, with two separate stroking cylinders, it would be theoretically possible to provide a restricted fluid communication between the two control fluid chambers of the two stroking cylinders. However, it would probably be preferred, from a standpoint of "packaging", to place the restricted orifices in the main controller, as is illustrated in the embodiment of FIG. 3.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A variable displacement hydrostatic pump of the type comprising housing means, a cylinder barrel rotatably mounted within said housing means and defining a plurality of cylinders, a piston disposed within each cylinder; a cam support disposed within said housing means is displaced from a neutral position in one of first being pivotable relative thereto, said cam means including a swash plate operably associated with each of said pistons to cause reciprocal movement thereof in response to rotation of said cylinder barrel when said cam means is displaced from a neutral position i one of first and second opposite directions; a fluid pressure actuated servo assembly comprising said housing means defining a servo cylinder, a servo piston disposed within said servo cylinder and cooperating therewith to define first and second servo chambers adapted for connection to a source of control fluid pressure; linkage means operably associated with said cam means and said servo piston whereby said cam means is displaced, from said neutral position, in said first direction, in response to control fluid pressure in said first servo chamber, and said cam means is displaced, from said neutral position, in said second direction, in response to control fluid pressure in said second servo chamber, characterized by:

(a) said servo piston defining orifice means providing restricted fluid communication between said first and second servo chambers; and (b) said orifice means being sized whereby, for a relatively large control input, the gain rate of the pump and servo assembly is substantially equal to a nominal gain rate, and, for a relatively small control input, the gain rate of the pump and servo assembly is substantially less than said nominal gain rate.

2. A variable displacement hydrostatic pump as claimed in claim 1, characterized by said source of control fluid pressure comprising a charge pump and control valve means operable to control the flow of control fluid pressure form said charge pump to said servo assembly in response to a control input.

3. A variable displacement hydrostatic pump as claimed in claim 2, characterized by control orifice means disposed in series flow relationship between said charge pump and said servo assembly, said control orifice means being effective to limit the gain rate of the pump and servo assembly to said nominal gain rate.

4. A variable displacement hydrostatic pump as claimed in claim 3, characterized by said control valve means comprising a control spool and said control orifice means being disposed in series flow relationship between said charge pump and said control spool.

5. A variable displacement hydrostatic pump as claimed in claim 3, characterized by said control orifice means comprising a control orifice member defining an orifice having a diameter in the range of about 0.040 inches to about 0.060 inches, and said orifice means defined by said servo piston comprises a servo orifice member defining an orifice having a diameter in the range of about 0.020 inches to about 0.035 inches.

6. A variable displacement hydrostatic pump of the type comprising housing means, a cylinder barrel rotatably mounted within said housing means and defining a plurality of cylinders, a piston disposed within each cylinder; a cam support disposed within said housing means, and cam means mounted on the cam support and being pivotable relative thereto, said cam means including a swash plate operably associated with each of said pistons to cause reciprocal movement thereof in response to rotation of said cylinder barrel when said cam means is displaced from a neutral position in one of first and second opposite directions; a fluid pressure actuated servo assembly comprising said housing means defining servo cylinder means, servo piston means disposed within said servo cylinder means and cooperating therewith to define first and second servo chambers adapted for connection to a source of control fluid pressure; linkage means operably associated with said cam means and said servo piston means whereby said cam means is displaced, from said neutral position, in said first direction, in response to control fluid pressure in said first servo chamber, and said cam means is displaced, from said neutral position, in said second direction, in response to control fluid pressure in said second servo chamber; said source of control fluid pressure including a charge pump and a controller in series flow relationship between said charge pump and said servo assembly, said controller cooperating with said servo assembly to define a control fluid pressure path communicating from said charge pump to said first servo chamber, characterized by:

(a) said controller defining orifice means providing restricted fluid communication between said control fluid pressure path and a source of low pressure; and (b) said orifice means being sized whereby, for a relatively large control input, the gain rate of the pump and the servo assembly is substantially equal to a nominal gain rate, and, for a relatively small control input, the gain rate of the pump and the servo assembly is substantially less than said nominal gain rate.

7. A variable displacement hydrostatic pump as claimed in claim 6, characterized by said servo cylinder means comprising a single servo cylinder, and said servo piston means comprising a single servo piston disposed within said servo cylinder means to define said first and second servo chambers within said servo cylinder.

8. A variable displacement hydrostatic pump as claimed in claim 6, characterized by said controller comprising a manual controller including a control spool and a control orifice means disposed in series flow relationship between said source of control fluid pressure and said fluid pressure actuated servo assembly.

9. A variable displacement hydrostatic pump as claimed in claim 8, characterized by said orifice means providing restricted fluid communication between said control fluid pressure path and a source of low pressure comprising said control spool defining fluid passage means in fluid communication with said source of low pressure, and further defining an orifice in fluid communication with said fluid passage means.

10. A variable displacement hydrostatic pump of the type comprising housing means, a cylinder barrel rotatably mounted within said housing means and defining a plurality of cylinders, a piston disposed within each cylinder; a cam support disposed within said housing means, and cam means mounted on the cam support and being pivotable relative thereto, said cam means including a swash plate operably associated with each of said pistons to cause reciprocal movement thereof in response to rotation of said cylinder barrel when said cam means is displaced from a neutral position in one of first and second opposite directions; a fluid pressure actuated servo assembly comprising said housing means defining servo cylinder means, servo piston means disposed within said servo cylinder means and cooperating therewith to define first and second servo chambers adapted for connection to a source of control fluid pressure; linkage means operably associated with said cam means and said servo piston means whereby said cam means is displaced, from said neutral position, in said first direction, in response to control fluid pressure in said first servo chamber, sand said cam means is displaced, from said neutral position, in said second direction, in response to control fluid pressure in said second servo chamber; said source of control fluid pressure including a charge pump and a controller in series flow relationship between said charge pump and said servo assembly, said controller cooperating with said servo assembly to define a control fluid pressure path communicating form said charge pump to said first servo chamber, characterized by:

(a) said fluid pressure actuated servo assembly defining orifice means providing restricted fluid communication between said control fluid pressure path and a source of low pressure; and (b) said orifice means being sized whereby, for a relatively large control input, the gain rate of the pump and the servo assembly is substantially equal to a nominal gain rate, and, for a relatively small control input, the gain rate of the pump and the servo assembly is substantially less than said nominal gain rate.

11. A variable displacement hydrostatic pump as claimed in claim 10, characterized by said servo cylinder means comprising a single servo cylinder, and said servo piston means comprising a single servo piston disposed within said servo cylinder means to define said first and second servo chambers within said servo cylinder.

12. A variable displacement hydrostatic pump as claimed in claim 10, characterized by said controller comprising a manual controller including a control spool and a control orifice means disposed in series flow relationship between said source of control fluid pressure and said fluid pressure actuated servo assembly.

13. A variable displacement hydrostatic pump as claimed in claim 12, characterized by said orifice means providing restricted fluid communication between said control fluid pressure path and a source of low pressure comprising said control spool defining fluid passage means in fluid communication with said source of low pressure, and further defining an orifice in fluid communication with said fluid passage means.

* * * * *